US011140495B2

(12) United States Patent
De Vries et al.

(10) Patent No.: US 11,140,495 B2
(45) Date of Patent: Oct. 5, 2021

(54) SOUND SIGNAL MODELLING BASED ON RECORDED OBJECT SOUND

(71) Applicant: GN HEARING A/S, Ballerup (DK)

(72) Inventors: Bert De Vries, Ballerup (DK); Almer Van Den Berg, Ballerup (DK)

(73) Assignee: GN HEARING A/S, Ballerup (DK)

( * ) Notice: Subject to any disclaimer, the term of this patent is extended or adjusted under 35 U.S.C. 154(b) by 154 days.

(21) Appl. No.: 16/465,788

(22) PCT Filed: Dec. 20, 2017

(86) PCT No.: PCT/EP2017/083807
§ 371 (c)(1),
(2) Date: May 31, 2019

(87) PCT Pub. No.: WO2018/122064
PCT Pub. Date: Jul. 5, 2018

(65) Prior Publication Data

US 2019/0394581 A1 Dec. 26, 2019

(30) Foreign Application Priority Data

Dec. 27, 2016 (EP) ..... 16206941

(51) Int. Cl.
*H04R 25/00* (2006.01)

(52) U.S. Cl.
CPC ..... *H04R 25/505* (2013.01); *H04R 25/558* (2013.01); *H04R 25/604* (2013.01); *H04R 2225/55* (2013.01)

(58) Field of Classification Search
CPC .... H04R 25/50; H04R 25/505; H04R 25/558; H04R 25/604; H04R 2225/43; H04R 2225/55; G10L 21/02; G10L 21/0208
See application file for complete search history.

(56) References Cited

U.S. PATENT DOCUMENTS 9,143,571 B2 9/2015 Kim et al.
9,966,077 B2 5/2018 Nishikawa
(Continued)

FOREIGN PATENT DOCUMENTS

CN 101515454 A 8/2009
CN 101593522 A 12/2009
(Continued)

OTHER PUBLICATIONS

Foreign Office Action dated Sep. 3, 2020 from related Chinese Patent Appln. No. 201780081012.3.
(Continued)

*Primary Examiner* — Matthew A Eason
(74) *Attorney, Agent, or Firm* — Vista IP Law Group, LLP

(57) ABSTRACT

A hearing device configured to be worn by a user, includes: a first input transducer for providing an input signal; a first processing unit configured for processing the input signal according to a first sound signal model; and an acoustic output transducer coupled to an output of the first processing unit for conversion of an output signal from the first processing unit into an audio output signal; wherein the hearing device is configured to obtain an input signal comprising a first signal part and a second signal part, the first signal part corresponding at least partly to a first object signal recorded by a recording unit; and wherein the hearing device is also configured to apply a first set of parameter values of a second sound signal model to the first sound signal model, and process the input signal according to the first sound signal model.

29 Claims, 9 Drawing Sheets

(56) References Cited

U.S. PATENT DOCUMENTS

| | | | |
|---|---|---|---|
| 2008/0175423 | A1 | 7/2008 | Hamacher |
| 2016/0099008 | A1 | 4/2016 | Barker et al. |

FOREIGN PATENT DOCUMENTS

| | | | |
|---|---|---|---|
| EP | 2 528 356 | A1 | 11/2012 |
| EP | 2528356 | | 11/2012 |
| EP | 2 876 899 | A1 | 5/2015 |
| EP | 2876899 | | 5/2015 |
| WO | WO 2018/122064 | A1 | 7/2018 |

OTHER PUBLICATIONS

Extended European Search Report dated Jun. 20, 2017 for corresponding European Application No. 16206941.3.

International Search Report and Written Opinion dated Feb. 7, 2018 for corresponding International Application No. PCT/EP2017/083807.

Loeliger, Andrea-Hans, et al. "The Factor Graph Appropach to Model-Based Signal Processing", Proceedings of the IEEE, Jun. 2007, vol. 95, No. 6, pp. 1295-1322.

Korl, Sascha. "A Factor Graph Approach to Signal Modelling, System Identification and Filtering" Published by Die Deutsche Bibliothek, Jul. 2005, Series in Signal and Information Processing, vol. 15.

Dauwels, Justin. "On Variational Message Passing on Factor Graphs", RIKEN BSI Technical Report, Jan. 2007.

Extended European Search Report for EP Patent Appln. No. 21155007.4 dated Aug. 23, 2021.

Van De Laar Thijs et al.: "A Probabilistic Modeling Approach to Hearing Loss Compensation", IEEE/ACM Transactions On Audio, Speech, and Language Processing, IEEE, USA, vol. 24, No. 11, Nov. 1, 2016 (Nov. 1, 2016), pp. 2200-2213, XPOI1622058, ISSN: 2329-9290, 001: 10.1109/TASLP.2016.2599275 [retrieved on Sep. 7, 2016].

James M Kates: "Chapter 10—Spectral Subtraction" In: "Digital Hearing Aids". Jan. 1, 2008 (Jan. 1, 2008). Plural Publishing. XP055688431. ISBN: 978-1-59756-317-8, pp. 291-318.

Trung Hieu Nguyen et al.: "section 8.5.1 Speaker Modeling" In: "Speech and Audio Processing for Coding. Enhancement and Recognition". Oct. 15, 2014 (Oct. 15, 2014). Springer New York. New York. NY. XP055688676, ISBN: 978-1-4939-1456-2 pp. 242-246, DOI: 10.1007/978-1-4939-1456-2_5.

Kori Sascha: "A factor graph approach to signal modelling. system identification and filtering, Chapters 1 to 3", ETH ZUrich Research Collection. Doctoral Thesis. Jan. 1, 2005 (Jan. 1, 2005), pp. 1-27, XP055831784, DOI: 10.3929/ethz-a-005064226 Retrieved from the Internet: URL: https://www.research-collection.ethz.ch/bitstream/handle/20.500.11850/82737/eth-2817602.pdf?sequence=2&i sAI lowed=y [retrieved on Aug. 12, 2021].

SOUND SIGNAL MODELLING BASED ON RECORDED OBJECT SOUND

RELATED APPLICATION DATA

This application is the national stage of International Application No. PCT/EP2017/083807 filed on Dec. 20, 2017, which claims priority to, and the benefit of, European Patent Application No. 16206941.3 filed on Dec. 27, 2016. The above applications are expressly incorporated by reference in their entireties herein.

FIELD

The present disclosure relates to a hearing device, an electronic device and a method for modelling a sound signal in a hearing device. The hearing device is configured to be worn by a user. The hearing device comprises a first input transducer for providing an input signal. The hearing device comprises a first processing unit configured for processing the input signal according to a first sound signal model. The hearing device comprises an acoustic output transducer coupled to an output of the first processing unit for conversion of an output signal from the first processing unit into an audio output signal. The method comprises recording a first object signal by a recording unit. The recording is initiated by the user of the hearing device.

BACKGROUND

Noise reduction methods in hearing aid signal processing typically make strong prior assumptions about what separates the noise from the target signal, the target signal usually being speech or music. For instance, hearing aid beamforming algorithms assume that the target signal originates from the look-ahead direction and single-microphone based noise reduction algorithms commonly assume that the noise signal is statistically much more stationary than the target signal. In practice, these specific conditions may not always hold, while the listener is still disturbed by non-target sounds. Thus, there is a need for improving noise reduction and target enhancement in hearing devices.

SUMMARY

Disclosed is a method for modelling a sound signal in a hearing device. The hearing device is configured to be worn by a user. The hearing device comprises a first input transducer for providing an input signal. The hearing device comprises a first processing unit configured for processing the input signal according to a first sound signal model. The hearing device comprises an acoustic output transducer coupled to an output of the first processing unit for conversion of an output signal from the first processing unit into an audio output signal. The method comprises recording a first object signal by a recording unit. The recording is initiated by the user of the hearing device. The method comprises determining, by a second processing unit, a first set of parameter values of a second sound signal model for the first object signal. The method comprises subsequently receiving, in the first processing unit of the hearing device, an input signal comprising a first signal part, corresponding at least partly to the first object signal, and a second signal part. The method comprises applying the determined first set of parameter values of the second sound signal model to the first sound signal model. The method comprises processing the input signal according to the first sound signal model.

Also disclosed is a hearing device for modelling a sound signal. The hearing device is configured to be worn by a user. The hearing device comprises a first input transducer for providing an input signal. The hearing device comprises a first processing unit configured for processing the input signal according to a first sound signal model. The hearing device comprises an acoustic output transducer coupled to an output of the first processing unit for conversion of an output signal from the first processing unit into an audio output signal. A first object signal is recorded by a recording unit. The recording is initiated by the user of the hearing device. A first set of parameter values of a second sound signal model is determined for the first object signal by a second processing unit. The hearing device is configured for subsequently receiving, in the first processing unit of the hearing device, an input signal comprising a first signal part, corresponding at least partly to the first object signal, and a second signal part. The hearing device is configured for applying the determined first set of parameter values of the second sound signal model to the first sound signal model. The hearing device is configured for processing the input signal according to the first sound signal model.

Also disclosed is a system. The system comprises a hearing device, configured to be worn by a user, and an electronic device. The electronic device comprises a recording unit. The electronic device comprises a second processing unit. The electronic device is configured for recording a first object signal by the recording unit. The recording is initiated by the user of the hearing device. The electronic device is configured for determining, by the second processing unit, a first set of parameter values of a second sound signal model for the first object signal. The hearing device comprises a first input transducer for providing an input signal. The hearing device comprises a first processing unit configured for processing the input signal according to a first sound signal model. The hearing device comprises an acoustic output transducer coupled to an output of the first processing unit for conversion of an output signal from the first processing unit into an audio output signal. The hearing device is configured for subsequently receiving, in the first processing unit of the hearing device, an input signal comprising a first signal part, corresponding at least partly to the first object signal, and a second signal part. The hearing device is configured for applying the determined first set of parameter values of the second sound signal model to the first sound signal model. The hearing device is configured for processing the input signal according to the first sound signal model. The electronic device may further comprise a software application comprising a user interface configured for being controlled by the user for modifying the first set of parameter values of the sound signal model for the first object signal.

It is an advantage that the user can initiate recording an object signal, such as the first object signal, since hereby a set of parameter values of the object signal is determined of the sound signal models, which can be applied whenever the hearing device receives an input signal comprising at least partly a signal part corresponding to, similar to or resembling the previously recorded object signal. Hereby the input signal can be noise suppressed if the recorded signal was a noise signal, such as noise from a particular machine, or the input signal can be target enhanced if the recorded signal was a desired target signal, such as speech from the user's spouse or music.

It is an advantage that the hearing device may apply or suggest to the user to apply one of the determined sets of parameters values for an object signal, which may be in form of a noise pattern, in its first sound signal model, which may be or may comprise a noise reduction algorithm, based on matching of the noise pattern in the object signal to the input signal received in the hearing device. The hearing device may have means for remembering the settings and/or tuning for the particular environment, where the object signal was recorded. The user's decisions regarding when to apply the noise reduction, or target enhancement, may be saved as user preferences thus leading to an automated personalized noise reduction system and/or target enhancement system, where the hearing device automatically applies the suitable noise reduction or target enhancement parameters values.

It is an advantage that the method, hearing device and/or electronic device may provide for constructing an ad hoc noise reduction or target enhancement algorithm by the hearing device user, under in situ conditions.

It is a further advantage that the method and hearing device and/or electronic device may provide for a patient-centric or user-centric approach by giving the user partial control of what his/her hearing aid algorithm does to the sound.

Further it is an advantage that the method and hearing device may provide for a very simple user experience by allowing the user to just record an annoying sound or a desired sound and optionally fine-tune the noise suppression or target enhancement of that sound. If it doesn't work as desired, then the user simply cancels the algorithm.

Furthermore, it is an advantage that the method and hearing device may provide for personalization by that the hearing device user can create a personalized noise reduction system and/or target enhancement system that is tuned to the specific environments and preferences of the user.

It is a further advantage that the method and hearing device may provide for extensions, as the concept allows for easy extensions to more advanced realizations.

The method is for modelling a sound signal in a hearing device and/or for processing a sound signal in a hearing device. The modelling and/or processing may be for noise reduction or target enhancement of the input signal. The input signal is the incoming signal or sound signal or audio received in the hearing device.

The first sound signal model may be a processing algorithm in the hearing device. The first sound signal model may provide for noise reduction and/or target enhancement of the input signal. The first sound signal model may provide both for hearing compensation for the user of the hearing device and provide for noise reduction and/or target enhancement of the input signal. The first sound signal model may be the processing algorithm in the hearing device which both provide for hearing compensation and for the noise reduction and/or target enhancement of the input signal. The first and/or the second sound signal model may be a filter, the first and/or the second sound signal model may comprise a filter, or the first and/or the second sound signal model may implement a filter. The parameter values may be filter coefficients. The first sound signal model comprises a number of parameters.

The hearing device may be a hearing aid, such as an in-the-ear hearing aid, a completely-in-the-canal hearing aid, or a behind-the-ear hearing device. The hearing device may be one hearing device in a binaural hearing device system comprising two hearing devices. The hearing device may be a hearing protection device. The hearing device may be configured to worn at the ear of a user.

The second sound signal model may be a processing algorithm in an electronic device. The electronic device may be associated with the hearing device. The electronic device may be a smartphone, such as an iPhone, a personal computer, a tablet, a personal digital assistant and/or another electronic device configured to be associated with the hearing device and configured to be controlled by the user of the hearing device. The second sound signal model may be a noise reduction and/or target enhancement processing algorithm in the electronic device. The electronic device may be provided external to the hearing device.

The second sound signal model may be a processing algorithm in the hearing device.

The first input transducer may be a microphone in the hearing device. The acoustic output transducer may be a receiver, a loudspeaker, a speaker of the hearing device for transmitting the audio output signal into the ear of the user of the hearing device.

The first object signal is the sound, e.g. noise signal or target signal, which the hearing device user wishes to suppress if it is a noise signal, and which the user wishes to enhance if it is a target signal. The object signal may ideally be a "clean" signal substantially only comprising the object sound and nothing else (ideally). Thus the object signal may be recorded under ideal conditions, such as under conditions where only the object sound is present. For example if the object sound is a noise signal from a particular factory machine in the work place where the hearing device user works, then the hearing device user may initiate the recording of that particular object signal, when that particular factory machine is the only sound source providing sound. Thus, all other machines or sound sources should ideally be silent. The user typically records the object signal for only a few seconds, such as for about one second, two seconds, three second, four seconds, five seconds, six seconds, seven seconds, eight seconds, nine seconds, 10 seconds etc.

The recording unit which is used to record the object signal, initiated by the user of the hearing device, may typically be provided in an electronic device, such as the user's smartphone. The microphone in the smartphone may be used to record to object signal. The microphone in the smartphone may be termed a second input transducer in order to distinguish this electronic device input transducer recording the object signal from the hearing device input transducer providing the input signal in the hearing device.

The recording of the object signal is initiated by the user of the hearing device. Thus it is the hearing device user himself/herself who initiates the recording of the object signal, for example using his/her smartphone for the recording. It is not the hearing device initiating the recording of the object signal. Thus the present method distinguishes from traditional noise suppression or target enhancement methods in hearing aids, where the hearing aid typically receives sound and the processor of the hearing aid is configured to decide which signal part is noise and which signal part is a target signal.

In the present method, the user actively decides which object signals he/she wishes to record, preferably using his/her smartphone, in order to use these recorded object signals to improve the noise suppression or target enhancement processing in the hearing device next time a similar object signal appear.

The method comprises determining, by a second processing unit, a first set of parameter values of a second sound signal model for the first object signal. Determining the parameter values may comprise estimating, computing, and/or calculating the parameter values. The determination is performed in a second processing unit. The second processing unit may be a processing unit of the electronic device. The second processing unit may be a processing unit of the hearing device, such as the same processing unit as the first processing unit. However, typically, there may not be enough processing power in a hearing device, so preferably the second processing unit is provided in the electronic device having more processing power than the hearing device.

The two method steps of recording the object signal and determining the parameter values may thus be performed in the electronic device. These two steps may be performed "offline" i.e. before the actual noise suppression or target enhancement of the input signal should be performed. These two steps relate to the building of the model or the training or learning of the model. The generation of the model comprise determining the specific parameter values to be used in the model for the specific object signal.

The next method steps relate to performing the signal processing of the input signal in the hearing device using the parameter values determined in the previous steps. Thus, these steps are performed "online" i.e. when an input signal is received in the hearing device, and when this input signal comprises a first signal part at least partly corresponding to or being similar to or resembling the object signal, which the user wishes to be either suppressed, if the object signal is a noise signal, or to be enhanced, if the object signal is a target signal or a desired signal. These steps of the signal processing part of the method comprises subsequently receiving, in the first processing unit of the hearing device, an input signal comprising a first signal part, corresponding at least partly to the first object signal, and a second signal part. The method comprises applying the determined first set of parameter values of the second sound signal model to the first sound signal model. The method comprises processing the input signal according to the first sound signal model.

Thus after the parameter value calculations in the model building phase, the actual noise suppression or target enhancement of the input signal in the hearing device can be performed using the determined parameter values in the signal processing phase.

The recorded object signal may be an example of a signal part of a noise signal from a particular noise source. When the hearing device subsequently receives an input comprising a first signal part which at least partly corresponds to the object signal, this means that some part of the input signal corresponds to or is similar to or resembles the object signal, for example because the noise signal is from the same noise source. Thus the first part of the input signal which at least partly corresponds to the object signal may not be exactly the same signal as the object signal. Sample for sample of the object signal and the first part of the input signal, the signals may not be the same. The noise pattern may not be exactly the same in the recorded object signal and in the first part of the input signal. However, for the user, the signals may be perceived as the same signal, such as the same noise or the same kind of noise, for example if the source of the noise, e.g. a factory machine, is the same for the object signal and for the first part of the input signal. The determination as to whether the first signal part at least partly corresponds to the object signal, and thus that some part of the input signal corresponds to or is similar to or resembles the object signal, may be made by frequency analysis and/or frequency pattern analysis. The determination as to whether the first signal part at least partly corresponds to the object signal, and thus that some part of the input signal corresponds to or is similar to or resembles the object signal, may be made by Bayesian inference, for example by estimating the similarity of time-frequency domain patterns for the input signal, or at least the first part of the input signal, and the object signals Thus, the noise suppression or target enhancement part of the processing may be substantially the same in the first sound signal model in the hearing device and in the second sound signal model in the electronic device, as the extra processing in the first sound signal model may be the hearing compensation processing part for the user.

The first signal part of the input signal may correspond to, at least partly, or being similar to, at least partly, or resemble, at least partly the object signal. The second signal part of the input signal may be the remaining part of the input signal, which does not correspond to the object signal. For example the first signal part of the input signal may be a noise signal resembling or corresponding at least partly to the object signal. Thus this first part of the input signal should then be suppressed. The second signal part of the input signal may then be the rest of the sound, which the user wishes to hear. Alternatively, the first signal part of the input signal may be a target or desired signal resembling or corresponding at least partly to the object signal, e.g. speech from a spouse. Thus this first part of the input signal should then the enhanced. The second signal part of the input signal may then be the rest of the sound, which the user also may wish to hear but which is not enhanced.

In some embodiments the method comprises recording a second object signal by the recording unit. The recording is initiated by the user of the hearing device. The method comprises determining, by the second processing unit, a second set of parameter values of the second sound signal model for the second object signal. The method comprises subsequently receiving, in the first processing unit of the hearing device, an input signal comprising a first signal part, corresponding at least partly to the second object signal, and a second signal part. The method comprises applying the determined second set of parameter values of the second sound signal model to the first sound signal model. The method comprises processing the input signal according to the first sound signal model. The second object signal may be another object signal than the first object signal. The second object signal may for example be from a different kind of sound source, such as from a different noise source or from another target person, than the first object signal. It is an advantage that the user can initiate recording different object signals, such as the first object signal and the second object signal, since hereby the user can create his/her own personalised collection or library of sets of parameter values of the sound signal models for different object signals, which can be applied whenever the hearing device receives an input signal comprising at least partly a signal part corresponding to, similar to or resembling one of the previously recorded object signals.

In some embodiments the method comprises recording a plurality of object signals by the recording unit, each recording being initiated by the user of the hearing device.

In some embodiments, the object signal may be recorded by the first transducer and provided to the second processing unit. The object signal recorded by the first transducer may be provided to the second processing unit e.g. via audio streaming.

In some embodiments the determined first set of parameter values of the second sound signal model is stored in a storage. The determined first set of parameter values of the second sound signal model may be configured to be retrieved from the storage by the second processing unit. The storage may be arranged in the electronic device. The storage may be arranged in the hearing device. If the storage is arranged in the electronic device, the parameter values may be transmitted from the storage in the electronic device to the hearing device, such as to first processing unit of the hearing device. The parameters values may be retrieved from the storage when the input signal in the hearing device comprises at least partly a first signal part corresponding to, being similar to or resembling the object signal from which the parameter values were determined.

In some embodiments the method comprises generating a library of determined respective sets of parameters values for the second sound signal model for the respective object signals. The object signals may comprise a plurality of object signals, including at least the first object signal and the second object signal. The determined respective set of parameter values for the second sound signal model for the respective object signal may be configured to be applied to the first sound signal model, when the input signal comprises at least partly the respective object signal. Thus the library may be generated offline, e.g. when the hearing device is not processing input signals corresponding at least partly to an object signal. The library may be generated in the electronic device, such as in a second processing unit or in a storage. The library may be generated in the hearing device, such as in the first processing unit or in a storage. The determined respective set of parameter values may be configured to be applied to the first sound signal model, when the input signal comprises a first signal part at least partly corresponding to the respective object signal, thus the application of the parameter values to the first sound signal model may be performed online, e.g. when the hearing device receives an input signal to be noise suppressed or target enhanced.

In some embodiments modelling or processing the input signal in the hearing device comprises providing a pre-determined second sound signal model. Modelling the input signal may comprise determining the respective set of parameter values for the respective object signal for the pre-determined second sound signal model. The second sound signal model may be a pre-determined model, such as an algorithm. The first sound signal model may be a pre-determined model, such as an algorithm. Providing the pre-determined second and/or first sound signal models may comprise obtaining or retrieving the first and/or second sound signal models in the first and/or second processing unit, respectively, and in a storage in the hearing device and/or in the electronic device.

In some embodiments the second processing unit is provided in an electronic device. The determined respective set of parameter values of the second sound signal model for the respective object signal may be sent, such as transmitted, from the electronic device to the hearing device to be applied to the first sound signal model. Alternatively the second processing unit may be provided in the hearing device, for example the first processing unit and the second processing unit may be the same processing unit.

In some embodiments the recording unit configured for recording the respective object signal(s) is a second input transducer of the electronic device. The second input transducer may be microphone, such as a build-in microphone of the electronic device, such as the microphone in a smartphone. Further the recording unit may comprise recording means, such as means for recording and saving the object signal.

In some embodiments the respective set of parameter values of the second sound signal model for the respective object signal is configured to be modified by the user on a user interface. The user interface may be a graphical user interface. The user interface can be a visual user part of a software application, such as an app, on the electronic device, for example a smartphone with a touch-sensitive screen. The user interface may be a mechanical control canal on the hearing device. The user may control the user interface with his/her fingers. The user may modify the parameters values for the sound signal model in order to improve the noise suppression or target enhancement of the input signal. The user may also modify other features of the sound signals models, and/or of the modelling or processing of the input signal. The user interface may be controlled by the user through for example gestures, pressing on buttons, such as soft or mechanical buttons. The user interface may be provided and/or controlled on a smartphone and/or on a smartwatch worn by the user.

In some embodiments processing the input signal according to the first sound signal model comprises estimating a set of average spectral power coefficients in each frequency band of a filter bank of the first sound signal model.

In some embodiments processing the input signal according to the first sound signal model comprises applying the estimated average spectral power coefficients in a spectral subtraction calculation, where a fixed object spectrum is subtracted from a time-varying frequency spectrum of the input signal. A tunable scalar impact factor may be added to the fixed object spectrum. The spectral subtraction calculation may be a spectral subtraction algorithm or model.

In some embodiments the spectral subtraction calculation estimates a time-varying impact factor based on specific features in the input signal. The specific features in the input signal may be frequency features. The specific features in the input signal may be features that relate to acoustic scenes such as speech-only, speech-in-noise, in-the-car, at-a-restaurant, etc.

In some embodiments modelling the input signal in the hearing device comprises a generative probabilistic modelling approach. Thus the generative probabilistic modelling may be performed by matching to the input signal on a sample by sample basis or pixel by pixel basis. The matching may be on the higher order signal, thus if the higher order statistics are the same for, at least part of, the input signal and the object signal, then the sound, such as the noise sound or the target sound, may be the same in the signals. A pattern of similarity of the signals may be generated. The generative probabilistic modelling approach may handle the signal even if, for example, the noise is not regular or continuous. The generative probabilistic modelling approach may be used over longer time span, such as over several seconds. A medium time span may be a second. A small time span may be less than a second. Thus both regular and irregular patterns, for example noise pattern, may be handled.

In some embodiments the first object signal is a noise signal, which the user of the hearing device wishes to suppress in the input signal. The noise signal may for example be machine noise from a particular machine, such as a factory machine, a computer humming etc., it may be traffic noise, the sound of the user's partner snoring etc.

In some embodiments the first object signal is a desired signal, which the user of the hearing device wishes to enhance in the input signal. The desired signal or target signal may be for example music or speech, such as the voice of the user's partner, colleague, family member etc.

The system may comprise an end user app that may run on a smartphone, such as an iPhone, or Android phone, for quickly designing an ad hoc noise reduction algorithm. The procedure may be as follows:

Under in situ conditions, the end user records with his smartphone a fragment of a sound that he wants to suppress. When the recording is finished, the parameters of a pre-determined noise suppression algorithm are computed by an 'estimation algorithm' on the smartphone. Next, the estimated parameter values are sent to the hearing aid where they are applied in the noise reduction algorithm. Next, the end user can fine-tune the performance of the noise reduction algorithm online by manipulation of a key parameter through turning for example a dial in the user interface of the smartphone app.

It is an advantage that the entire method of recording an object signal, estimation of parameter values, and application of the estimated parameter values in the sound signal model of the hearing device, such as in a noise reduction algorithm of the hearing device, is performed in-situ, or in the field. Thus, no interaction by professionals or by programmers is necessary to assist with the development of a specific noise reduction algorithm, and the method is a user-initiated and/or user-driven process. A user may create a personalized hearing experience, such as a personalized noise reduction or signal enhancement hearing experience Described below is an example with a simple possible realization of the proposed method. For instance, the end user records for about 5 seconds the snoring sound of his/her partner or the sound of a running dishwashing machine. In a simple realization, the parameter estimation procedure computes the average spectral power in each frequency band of the filter bank of the hearing aid algorithm. Next, these average spectral power coefficients are sent to the hearing aid where they are applied in a simple spectral subtraction algorithm where a fixed noise spectrum, times a tunable scalar impact factor, is subtracted from the time-varying frequency spectrum of the total received signal. The user may tune the noise reduction algorithm online by turning a dial in the user interface of his smartphone app. The dial setting is sent to the hearing aid and controls the scalar impact factor.

In a further example, a user may record an input signal for a specific time or duration. The recorded input signal may comprise one or more sound segments. The user may want to suppress or enhance one or more selected sound segments. The user may define the one or more sound segments of the recorded input signal, alternatively or additionally, the processing unit may define or refine the sound segments of the recorded input signal based on input signal characteristics. It is an advantage that a user may thereby also provide a sound profile corresponding to e.g. a very short noise, occurring infrequently which may otherwise be difficult to record.

More advanced realizations of the same concept are also possible. For instance, the spectral subtraction algorithm may estimate by itself a time-varying impact factor based on certain features in the received total signal.

In an extended realization, the user can create a library of personal noise patterns. The hearing aid could suggest in situ to the user to apply one of these noise patterns in its noise reduction algorithm, based on 'matching' of the stored pattern to the received signal. End user decisions could be saved as user preferences thus leading to an automated personalized noise reduction system.

Even more general than the noise reduction system described above, disclosed is a general framework for ad hoc design of an audio algorithm in a hearing aid by the following steps:

First a snapshot of environment is captured by the user. The snapshot may be a sound, a photo, a movie, a location etc. Then the user labels the snapshot. The labelling may be for example "dislike", "like" etc. An offline processing where parameter values a pre-determined algorithm or sound signal model is estimated is performed. This processing may be performed on the smartphone and/or in a Cloud, such as in remote storage. Then the algorithm parameters or sets of parameter values in the hearing device are updated based on the above processing. In similar environmental conditions the personalized parameters are applied in situ to an input signal in the hearing device.

The present disclosure relates to different aspects including the method and hearing device described above and in the following, and corresponding hearing devices, methods, devices, systems, networks, kits, uses and/or product means, each yielding one or more of the benefits and advantages described in connection with the first mentioned aspect, and each having one or more embodiments corresponding to the embodiments described in connection with the first mentioned aspect and/or disclosed in the appended claims.

A method for signal modelling in a hearing device configured to be worn by a user, the hearing device comprising a first input transducer, a first processing unit coupled to the first input transducer and configured to perform signal processing according to a first sound signal model, and an acoustic output transducer for conversion of an output signal from the first processing unit into an audio output signal, the method comprising: recording a first object signal by a recording unit; determining, by a second processing unit, a first set of parameter values of a second sound signal model for the first object signal; receiving, in the first processing unit of the hearing device, an input signal comprising a first signal part and a second signal part, the first signal part corresponding at least partly to the first object signal; applying the determined first set of parameter values of the second sound signal model to the first sound signal model; and processing the input signal according to the first sound signal model.

Optionally, the method further includes: recording a second object signal by the recording unit; determining, by the second processing unit, a second set of parameter values of the second sound signal model for the second object signal; receiving, in the first processing unit of the hearing device, an additional input signal comprising a first signal part and a second signal part, the first signal part of the additional input signal corresponding at least partly to the second object signal; applying the determined second set of parameter values of the second sound signal model to the first sound signal model; and processing the additional input signal according to the first sound signal model.

Optionally, the method further includes generating a library of sets of parameter values for the second sound signal model for respective object signals, the object signals comprising at least the first object signal and the second object signal, wherein the library of sets of parameter values comprises at least the first set of parameter values and the second set of parameter values.

Optionally, the method further includes determining whether the input signal corresponds at least partly to the first object signal, wherein the act of applying the determined first set of parameter values to the first sound signal model is performed if the input signal corresponds at least partly to the first object signal.

Optionally, the first set of parameter values of the second sound signal model is stored in a storage, and wherein the first set of parameter values of the second sound signal model is configured to be retrieved from the storage by the second processing unit.

Optionally, the second processing unit is in an electronic device, and wherein the first set of parameter values of the second sound signal model is sent from the electronic device to the hearing device to be applied to the first sound signal model.

Optionally, the recording unit comprises a second input transducer in an electronic device.

Optionally, the method further includes modifying the first set of parameter values of the second sound signal model based on an interface output from a user interface.

Optionally, the act of processing the input signal according to the first sound signal model comprises estimating a set of average spectral power coefficients in each frequency band of a filter bank of the first sound signal model.

Optionally, the act of processing the input signal according to the first sound signal model comprises applying the estimated average spectral power coefficients in a spectral subtraction calculation, wherein a fixed object spectrum is subtracted from a time-varying frequency spectrum of the input signal.

Optionally, the spectral subtraction calculation is performed to estimate a time-varying impact factor based on feature(s) in the input signal.

Optionally, the input signal is modelled in the hearing device using a generative probabilistic modelling approach.

Optionally, the first object signal is a noise signal to be suppressed in the input signal.

Optionally, the first object signal is a desired signal to be enhanced in the input signal.

Optionally, the act of recording is initiated by the user of the hearing device.

A hearing device configured to be worn by a user, includes: a first input transducer for providing an input signal; a first processing unit configured for processing the input signal according to a first sound signal model; and an acoustic output transducer coupled to an output of the first processing unit for conversion of an output signal from the first processing unit into an audio output signal; wherein the hearing device is configured to obtain an input signal comprising a first signal part and a second signal part, the first signal part corresponding at least partly to a first object signal recorded by a recording unit; and wherein the hearing device is also configured to apply a first set of parameter values of a second sound signal model to the first sound signal model, and process the input signal according to the first sound signal model.

Optionally, the first set of parameter values of the second sound signal model is associated with the first object signal.

A system includes the hearing device, and an electronic device that comprises the recording unit.

A system includes the hearing device, and a second processing unit configured to determine the first set of parameter values of the second sound signal model for the first object signal.

A system includes a hearing device configured to be worn by a user and an electronic device; wherein the hearing device comprises a first input transducer, a first processing unit coupled to the first input transducer and configured to perform signal processing according to a first sound signal model, and an acoustic output transducer coupled to an output of the first processing unit for conversion of an output signal from the first processing unit into an audio output signal; wherein the electronic device comprises a recording unit, and a second processing unit, wherein the electronic device is configured to record a first object signal by the recording unit, and wherein the second processing unit of the electronic device is configured to determine a first set of parameter values of a second sound signal model for the first object signal; wherein the hearing device is configured to obtain an input signal comprising a first signal part and a second signal part, the first signal part corresponding at least partly to the first object signal; and wherein the hearing device is also configured to apply the first set of parameter values of the second sound signal model to the first sound signal model, and process the input signal according to the first sound signal model.

Other features and advantageous will be described in the detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
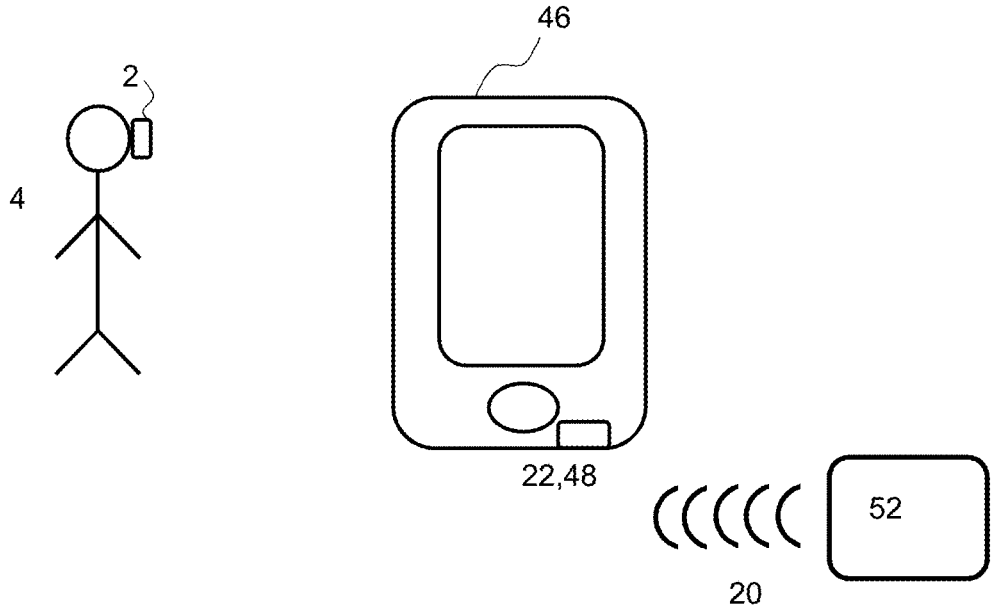
FIG. 1 schematically illustrates an example of a hearing device and an electronic device and a method for modelling a sound signal in the hearing device.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

Figure 2:
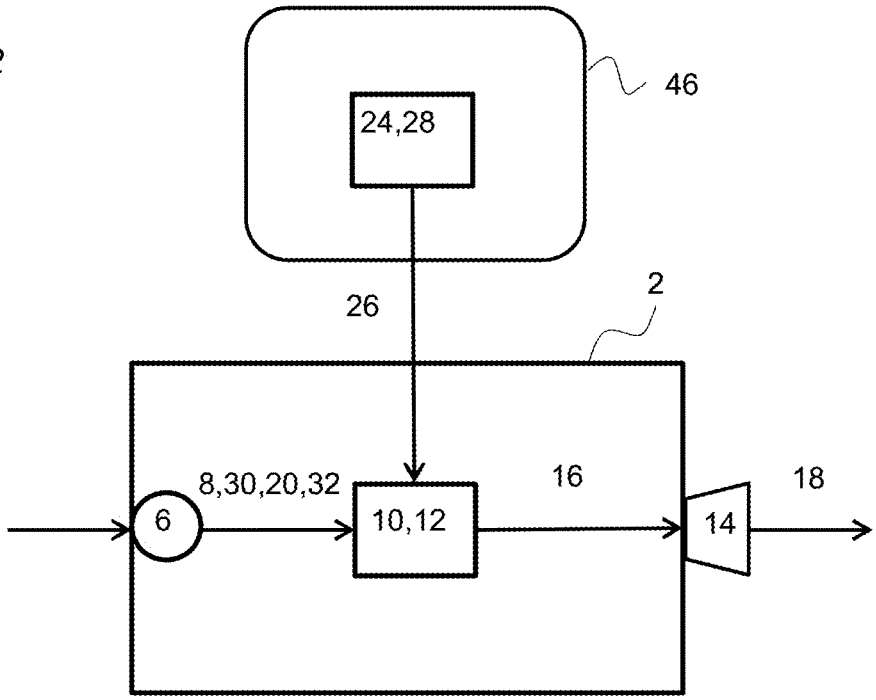
FIG. 2 schematically illustrates an example of a hearing device and an electronic device and a method for modelling a sound signal in the hearing device.

FIGS. 1 and 2 schematically illustrate an example of a hearing device 2 and an electronic device 46 and a method for modelling a sound signal in the hearing device 2. The hearing device 2 is configured to be worn by a user 4. The hearing device 2 comprises a first input transducer 6 for providing an input signal 8. The first input transducer may comprise a microphone. The hearing device 2 comprises a first processing unit 10 configured for processing the input signal 8 according to a first sound signal model 12. The hearing device 2 comprises an acoustic output transducer 14 coupled to an output of the first processing unit 10 for conversion of an output signal 16 from the first processing unit 10 into an audio output signal 18. The method comprises recording a first object signal 20 by a recording unit 22. The first object signal 20 may originate from or be transmitted from a first sound source 52. The first object signal 20 may be a noise signal, which the user 4 of the hearing device 2 wishes to suppress in the input signal 8. The first object signal 20 may be a desired signal, which the user 4 of the hearing device 2 wishes to enhance in the input signal 8.

The recording unit 22 may be an input transducer 48, such as a microphone, in the electronic device 46. The electronic device 46 may be a smartphone, a pc, a tablet etc. The recording is initiated by the user 4 of the hearing device 2. The method comprises determining, by a second processing unit 24, a first set of parameter values 26 of a second sound signal model 28 for the first object signal 20. The second processing unit 24 may be arranged in the electronic device 46. The method comprises subsequently receiving, in the first processing unit 10 of the hearing device 2, an input signal 8 comprising a first signal part 30, corresponding at least partly to the first object signal 20, and a second signal part 32. The method comprises, in the hearing device 2, applying the determined first set of parameter values 26 of the second sound signal model 28 to the first sound signal model 12. The method comprises, in the hearing device 2, processing the input signal 8 according to the first sound signal model 12.

Thus, the electronic device 46 comprises a recording unit 22 and a second processing unit 24. The electronic device 46 is configured for recording the first object signal 20 by the recording unit 22, where the recording is initiated by the user 4 of the hearing device 2. The electronic device 46 is further configured for determining, by the second processing unit 24, the first set of parameter values 26 of the second sound signal model 28 for the first object signal 20.

The electronic device may comprise the second processing unit 24. Thus the determined first set of parameter values 26 of the second sound signal model 28 for the first object signal 20 may be sent from the electronic device 46 to the hearing device 2 to be applied to the first sound signal model 12.

Figure 3:
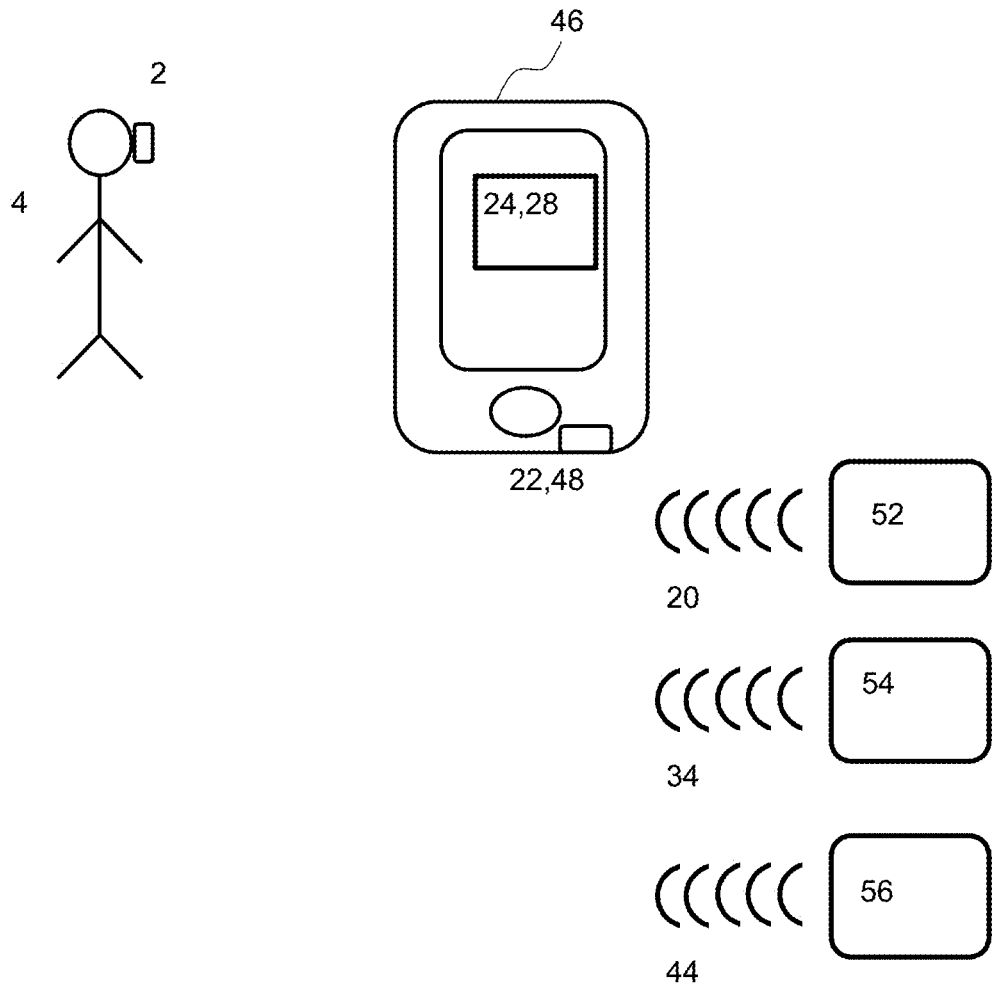
FIG. 3 schematically illustrates an example where the method comprises recording object signals by the recording unit.
Figure 4:
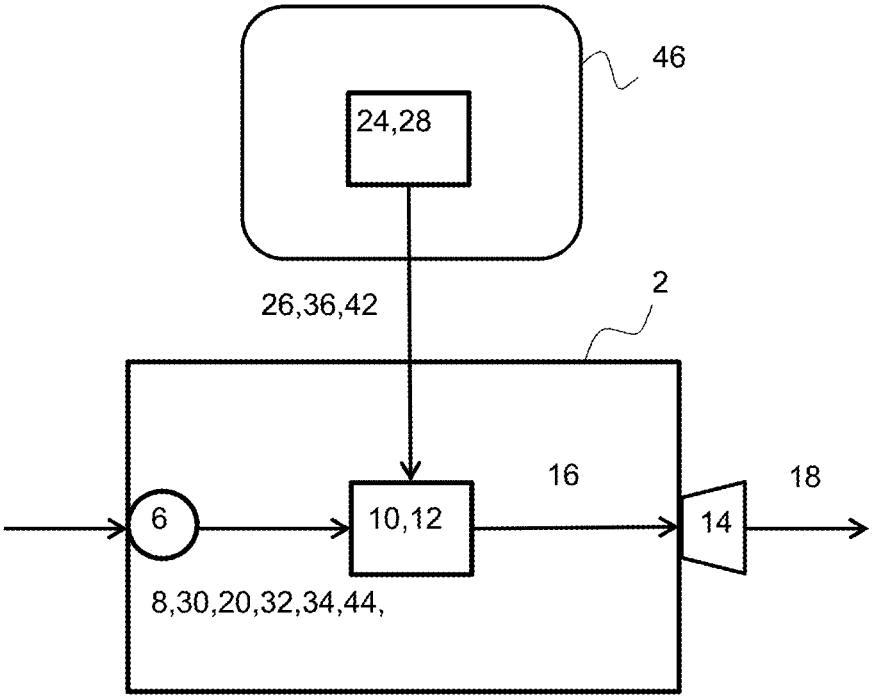
FIG. 4 schematically illustrates an example of a hearing device and an electronic device and a method for modelling a sound signal in the hearing device.

FIGS. 3 and 4 schematically illustrates an example where the method comprises recording a second object signal 34 by the recording unit 22, the recording being initiated by the user 4 of the hearing device 2. The second object signal 34 may originate from or be transmitted from a second sound source 54. The method comprises determining, by the second processing unit 24, a second set of parameter values 36 of the second sound signal model 28 for the second object signal 34. The method comprises subsequently receiving, in the first processing unit 10 of the hearing device 2, an input signal 8 comprising a first signal part 30, corresponding at least partly to the second object signal 34, and a second signal part 32. The method comprises applying the determined second set of parameter values 36 of the second sound signal model 28 to the first sound signal model 12. The method comprises processing the input signal 8 according to the first sound signal model 12. It is envisaged that further object signals may be recorded by the user from same or different sound sources, subsequently or at different times. Thus, a plurality of object signals may be recorded by the user. The method may further comprise determining corresponding set of parameter values for each of the plurality of sound signals.

The electronic device may comprise the second processing unit 24. Thus the determined second set of parameter values 36 of the second sound signal model 28 for the second object signal 34 may be sent from the electronic device 46 to the hearing device 2 to be applied to the first sound signal model 12.

Further, the method comprises recording a respective object signal 44 by the recording unit 22, the recording being initiated by the user 4 of the hearing device 2. The respective object signal 44 may originate from or be transmitted from a respective sound source 56. The method comprises determining, by the second processing unit 24, a respective set of parameter values 42 of the second sound signal model 28 for the respective object signal 44. The method comprises subsequently receiving, in the first processing unit 10 of the hearing device 2, an input signal 8 comprising a first signal part 30, corresponding at least partly to the respective object signal 44, and a second signal part 32. The method comprises applying the determined respective set of parameter values 42 of the second sound signal model 28 to the first sound signal model 12. The method comprises processing the input signal 8 according to the first sound signal model 12.

The electronic device may comprise the second processing unit 24. Thus the determined respective set of parameter values 42 of the second sound signal model 28 for the respective object signal 44 may be sent from the electronic device 46 to the hearing device 2 to be applied to the first sound signal model 12.

Figure 5A:
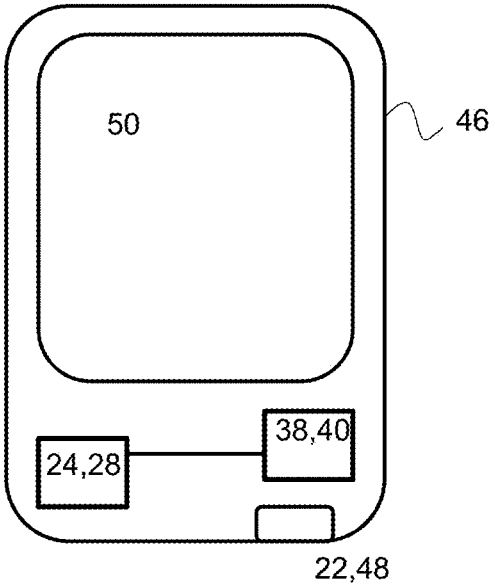
FIG. 5*a* schematically illustrates an example of an electronic device.

FIG. 5*a* schematically illustrates an example of an electronic device 46.

The electronic device may comprise the second processing unit 24. Thus the determined set of parameter values of the second sound signal model 28 for the object signal may be sent from the electronic device 46 to the hearing device to be applied to the first sound signal model.

The electronic device 46 may comprise a storage 38 for storing the determined first set of parameter values 26 of the second sound signal model 28. Thus, the determined first set of parameter values 26 of the second sound signal model 28 is configured to be retrieved from the storage 38 by the second processing unit 24.

The electronic device may comprise a library 40. Thus the method may comprise generating the library 40. The library 40 may comprise determined respective sets of parameters values 42, see FIGS. 3 and 4, for the second sound signal model 28 for the respective object signals 44, see FIGS. 3 and 4. The object signals 44 comprise at least the first object signal 20 and the second object signal 34.

The electronic device 46 may comprise a recording unit 22. The recording unit may be an second input transducer 48, such as a microphone for recording the respective object signals 44, the respective object signal 44 may comprise the first object signal 20 and the second object signal 34.

The electronic device may comprise a user interface 50, such as a graphical user interface. The user may, on the user interface 50, modify the respective set of parameter values 42 of the second sound signal model 28 for the respective object signal 44.

Figure 5B:
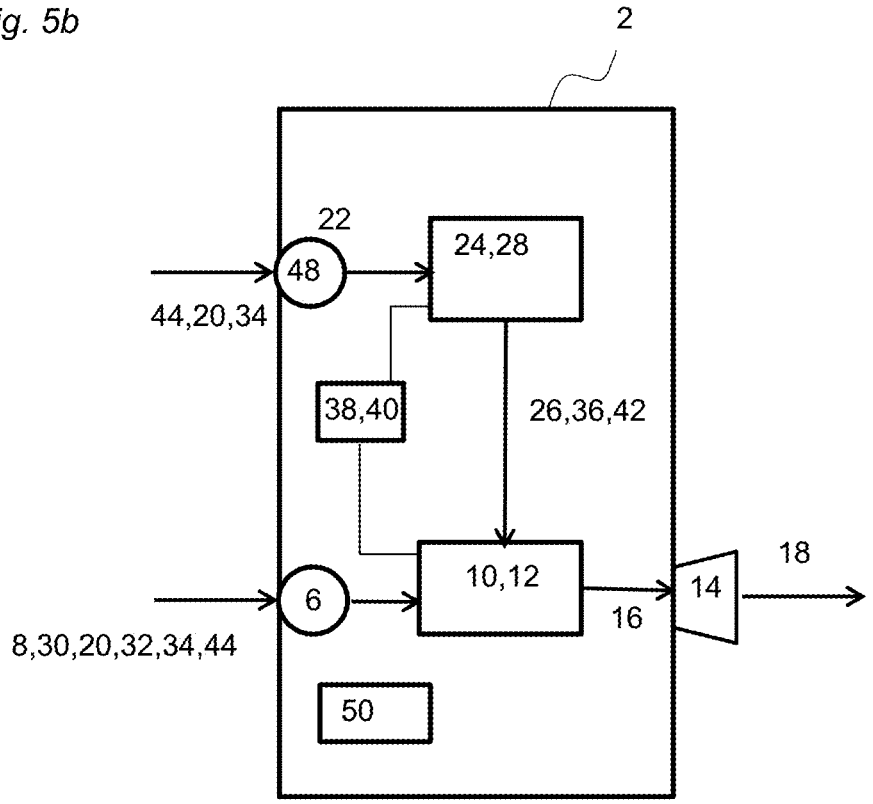
FIG. 5*b* schematically illustrates an example of a hearing device.

FIG. 5*b* schematically illustrates an example of a hearing device 2.

The hearing device 2 is configured to be worn by a user (not shown). The hearing device 2 comprises a first input transducer 6 for providing an input signal 8. The hearing device 2 comprises a first processing unit 10 configured for processing the input signal 8 according to a first sound signal model 12. The hearing device 2 comprises an acoustic output transducer 14 coupled to an output of the first processing unit 10 for conversion of an output signal 16 from the first processing unit 10 into an audio output signal 18.

The hearing device further comprises a recording unit 22. The recording unit may be a second input transducer 48, such as a microphone, for recording the respective object signals 44; the respective object signal 44 may comprise the first object signal 20 and the second object signal 34.

The method may comprise recording a first object signal 20 by the recording unit 22. The first object signal 20 may originate from or be transmitted from a first sound source (not shown). The first object signal 20 may be a noise signal, which the user of the hearing device 2 wishes to suppress in the input signal 8. The first object signal 20 may be a desired signal, which the user of the hearing device 2 wishes to enhance in the input signal 8.

The hearing device may furthermore comprise the second processing unit 24. Thus the determined set of parameter values of the second sound signal model 28 for the object signal may be processed in the hearing device to be applied to the first sound signal model. The second processing unit 24 may be the same as the first processing unit 10. The first processing unit 10 and second processing unit 24 may be different processing units.

The first input transducer 6 may be the same as the second input transducer 22. The first input transducer 6 may be different from the second input transducer 22.

The hearing device 2 may comprise a storage 38 for storing the determined first set of parameter values 26 of the second sound signal model 28. Thus, the determined first set of parameter values 26 of the second sound signal model 28 is configured to be retrieved from the storage 38 by the second processing unit 24 or the first processing unit 10. The hearing device may comprise a library 40. Thus the method may comprise generating the library 40. The library 40 may comprise determined respective sets of parameters values 42, see FIGS. 3 and 4, for the second sound signal model 28 for the respective object signals 44, see FIGS. 3 and 4. The object signals 44 comprise at least the first object signal 20 and the second object signal 34. In the hearing device, the storage 38 may comprise the library 40.

The hearing device may comprise a user interface 50, such as a graphical user interface, such as a mechanical user interface. The user may, via the user interface 50, modify the respective set of parameter values 42 of the second sound signal model 28 for the respective object signal 44.

Figure 6A:
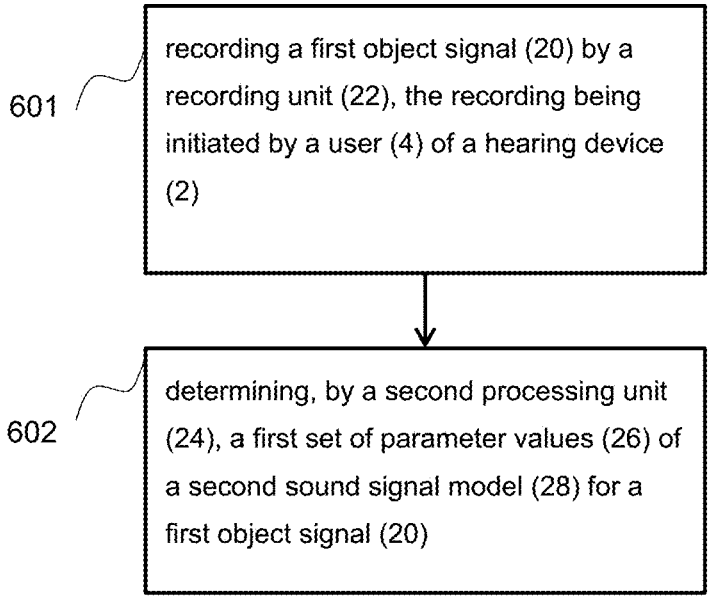
FIGS. 6*a*) and 6*b*) show an example of a flow chart of a method for modelling a sound signal in a hearing device.

FIGS. 6*a*) and 6*b*) show an example of a flow chart of a method for modelling a sound signal in a hearing device 2. The hearing device 2 is configured to be worn by a user 4. FIG. 6*a*) illustrates that the method comprises a parameter determination phase, which may be performed in an electronic device 46 associated with the hearing device 2. The method comprises, in a step 601, recording a first object signal 20 by a recording unit 22. The recording is initiated by the user 4 of the hearing device 2. The method comprises, in a step 602, determining, by a second processing unit 24, a first set of parameter values 26 of a second sound signal model 28 for the first object signal 20.

Figure 6B:
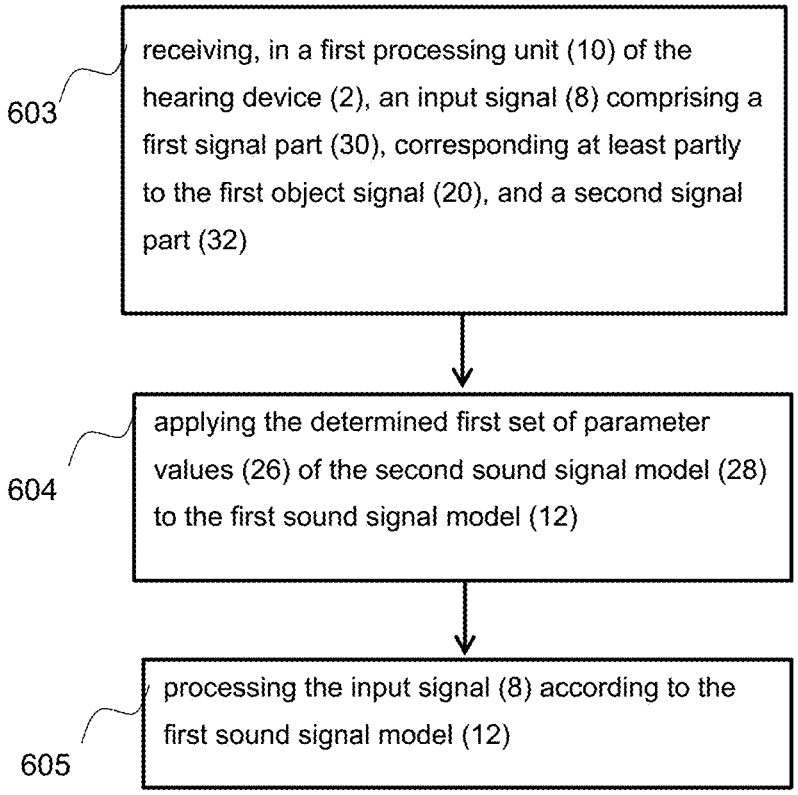

FIG. 6*b*) illustrates that the method comprises a signal processing phase, which may be performed in the hearing device 2. The hearing device 2 is associated with the electronic device 46 in which the first set of parameter values 26 was determined. Thus the first set of parameter values 26 may be transmitted from the electronic device 46 to the hearing device 2. The method comprises, in a step 603, subsequently receiving, in a first processing unit 10 of the hearing device 2, an input signal 8 comprising a first signal part 30, corresponding at least partly to the first object signal 20, and a second signal part 32. The method comprises, in a step 604, applying the determined first set of parameter values 26 of the second sound signal model 28 to the first sound signal model 12. The method comprises, in a step 605, processing the input signal 8 according to the first sound signal model 12.

Below disclosed is an example of a technical realization of the system. In general, multiple approaches to the proposed system are available. A generative probabilistic modeling approach may be used.

Model Specification

We assume that audio signals are sums of constituent source signals. Some of these constituent signals are desired, e.g. speech or music, and we may want to amplify those signals. Some other constituent sources may be undesired, e.g. factory machinery, and we may want to suppress those signals. To simplify matters, we write $$x_t = s_t + n_t$$

to indicate that an input signal or incoming audio signal $x_t$ is composed of a sum of a desired signal $s_t$ and an undesired ("noise") signal $n_t$. The subscript t holds the time index. As mentioned, there may be more than two sources present but we continue the exposition of the model for a mixture of one desired and one noise signal.

We focus here on attenuation of the undesired signal. In that case, we are interested in producing the output signal $$y_t = s_t + \alpha \cdot n_t$$

where $0 \leq \alpha < 1$ is an attenuation factor.

We may use a generative probabilistic modeling approach. This means that $$p(x_t | s_t, n_t) = \delta(x_t - s_t - n_t) \text{ and } p(y_t | s_t, n_t) = \delta(y_t - s_t - \alpha \cdot n_t).$$

Each source signal is modelled by a similar probabilistic Hierarchical Dynamic System (HDS). For a source signal $s_t$, the model is given by $$p(s, z, \theta) = p(\theta^{(1)}, \ldots, \theta^{(K)}) \prod_t p(s_t | z_t^{(1)}) p(z_t^{(1)} | z_{t-1}^{(1)}, z_t^{(2)}, \theta^{(1)}) \ldots p(z_t^{(K)} | z_{t-1}^{(K)}, \theta^{(K)}).$$

Figure 7:
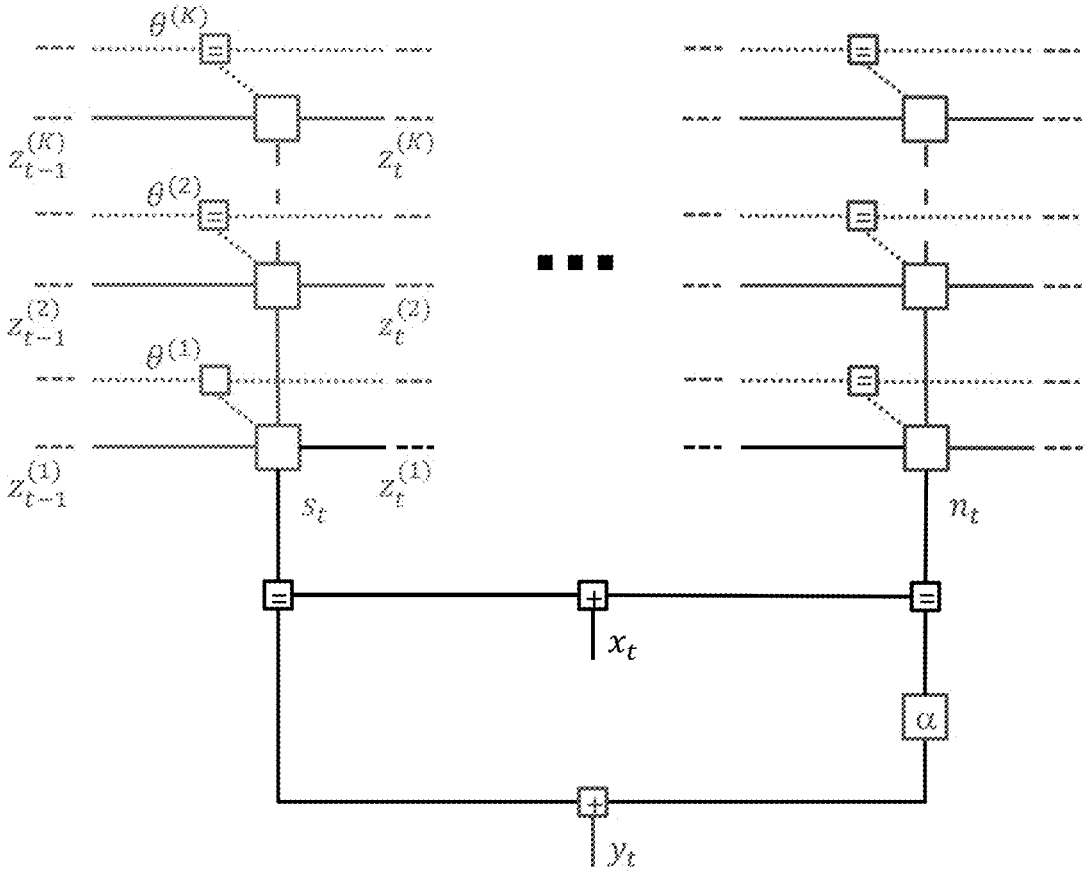
FIG. 7 schematically illustrates a Forney-style Factor Graph realization of a generative model.

In this model, we denote by $s_t$ the outcome ("observed") signal at time step t, $z_t^{(k)}$ is the hidden state signal at time step t in the $k^{th}$ layer, which is parameterized by $\theta^{(k)}$. We denote the full set of parameters by $\theta = \{\theta^{(1)}, \ldots, \theta^{(K)}\}$ and we collect all states in a similar manner in the variable s. In FIG. 7, we show a Forney-style Factor Graph (FFG) of this model. FFGs are a specific type of Probabilistic Graphical Model (Loeliger et al., 2007, Korl 2005).

Many well-known models submit to the equations of the prescribed HDS, including (hierarchical) hidden Markov models and Kalman filters and deep neural networks such as convolutional and recurrent neural works.

The generative model can be used to infer the constituent source signals from a received signal and subsequently we can adjust the amplification gains of individual signals so as to personalize the experiences of auditory scenes. Next, we discuss how to train the generative model, which is followed by a specification of the signal processing phase.

Training

We assume that the end user is situated in an environment where he has clean observations of either a desired signal class, e.g. speech or music, or an undesired signal class, e.g. noise sources such as factory machinery. For simplicity, we focus here on the case where he has clean observations of an undesired noise signal, corresponding to the object signal in the above. Let's denote a recorded sequence of a few seconds of this signal by D (i.e., the "data"). The training goal is to infer the parameters of a new source signal. Technically, this comes down to inferring $p(\theta|D)$ from the generative model and the recorded data.

In a preferred realization, we implement the generative model in a factor graph framework. In that case, $p(\theta|D)$ can be inferred automatically by a message passing algorithm such as Variational Message Passing (Dauwels, 2007). For clarity, we have shown an appropriate message passing schedule in FIG. 8.

Signal Processing

Figure 8:
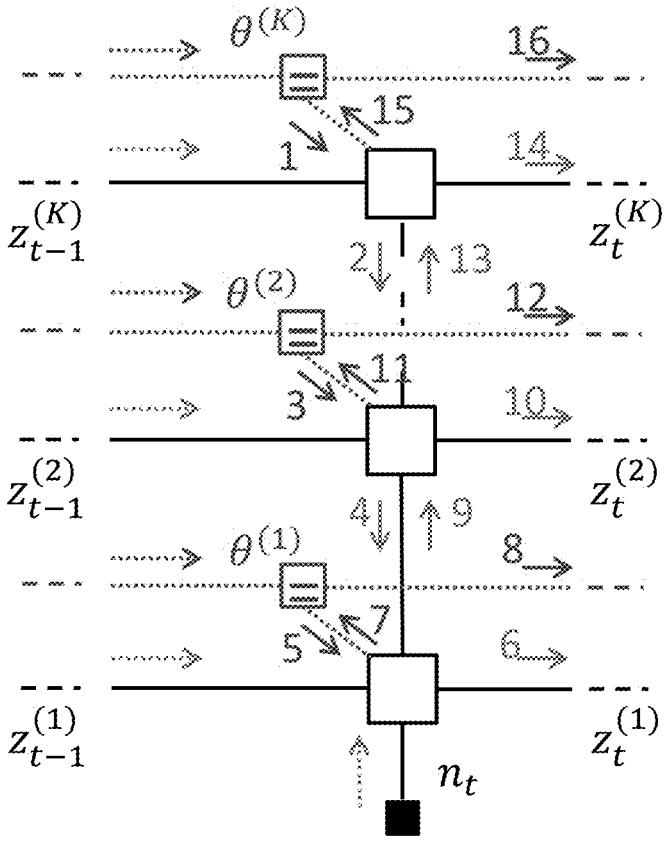
FIG. 8 schematically illustrates a message passing schedule.
Figure 9:
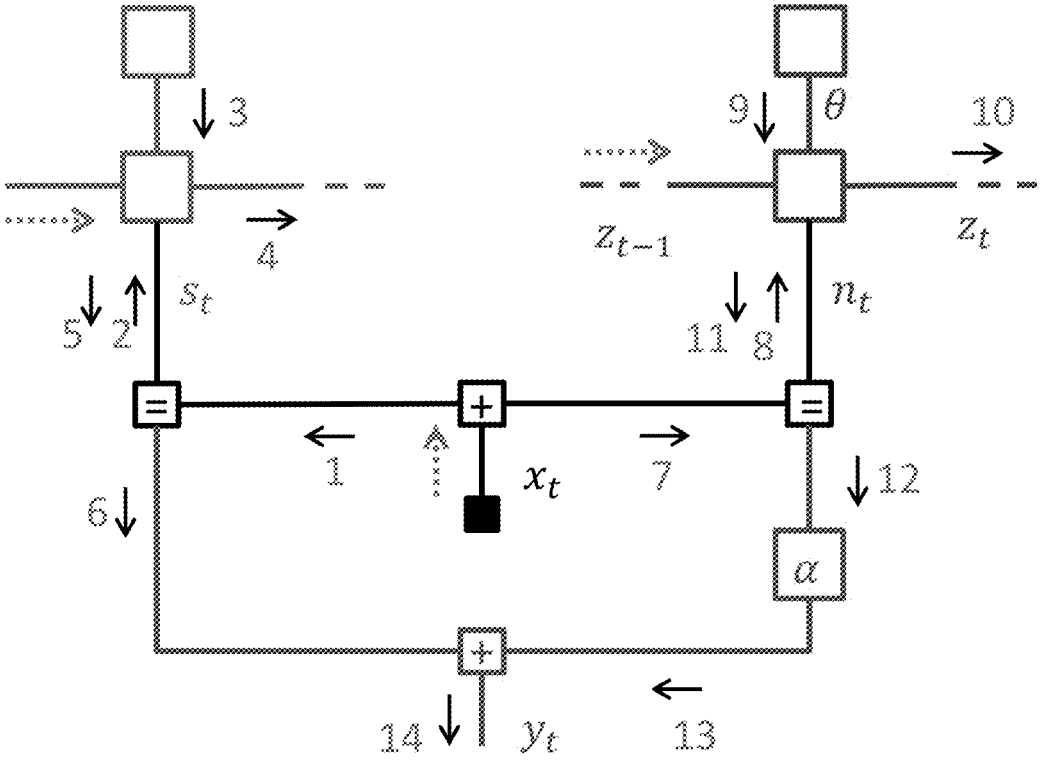
FIG. 9 schematically illustrates a message passing schedule.

FIG. 9 shows that given the generative model and an incoming audio signal $x_t$ that is composed of the sum of $s_t$ and $n_t$, we are interested in computing the enhanced signal $y_t$ through solving the inference problem $p(y_t, z_t|x_t, z_{t-1}, \theta)$. If the generative model is realized by the FFG as shown in FIG. 7, then the inference problem can be solved automatically by a message passing algorithm. In FIG. 8, we show the appropriate message passing sequence. Other approximate Bayesian inference procedures may also be considered for solving the same inference problem.

For Generative Model Figure

FIG. 7 schematically illustrates a Forney-style Factor Graph realization of the generative model. In this model, we assume that $x_t=s_t+n_t$ and the constituent source signals are generated by probabilistic Hierarchical Dynamic Systems, such as hierarchical hidden Markov models or multilayer neural networks. We assume that the output signal is generated by $y_t=s_t+\alpha\cdot n_t$.

For Learning Figure

FIG. 8 schematically illustrates a message passing schedule for computing $p(\theta|D)$ for a source signal where D comprises the recorded audio signal. This scheme tunes a generative source model to recorded audio fragments.

For Signal Processing Figure

FIG. 9 schematically illustrates a message passing schedule for computing $p(y_t, z_t|x_t, z_{t-1}, \theta)$ from the generative model and a new observation $x_t$. Note that, in order to simplify the figure, we have "closed-the-box" around the state and parameter networks in the generative model (Loeliger et al., 2007). This scheme executes the signal processing steps during the operational phase of the system.

REFERENCES

H. A. Loeliger et al., The Factor Graph Approach to Model-Based Signal Processing, Proc. of the IEEE, 95-6, 2007.

Sasha Korl, A Factor Graph Approach to Signal Modelling, System Identification and Filtering, Diss. ETH No. 16170, 2005.

Justin Dauwels, On Variational Message Passing on Factor Graphs, ISIT conference, 2007.

Although particular features have been shown and described, it will be understood that they are not intended to limit the claimed invention, and it will be made obvious to those skilled in the art that various changes and modifications may be made without departing from the scope of the claimed invention. The specification and drawings are, accordingly to be regarded in an illustrative rather than restrictive sense. The claimed invention is intended to cover all alternatives, modifications and equivalents.

LIST OF REFERENCES

2 hearing device
4 user
6 first input transducer
8 input signal
10 first processing unit
12 first sound signal model
14 acoustic output transducer
16 output signal
18 audio output signal
20 first object signal
22 recording unit
24 second processing unit
26 first set of parameter values
28 second sound signal model
30 first signal part corresponding at least partly to the first object signal 20
32 second signal part
34 second object signal
36 second set of parameter values
38 storage
40 library
42 respective set of parameter values
44 respective object signal
46 electronic device
48 second input transducer
52 first sound source
54 second sound source
56 respective sound source
58 system
601 step of recording a first object signal 20 by a recording unit 22;
602 step of determining, by a second processing unit 24, a first set of parameter values 26 of a second sound signal model 28 for the first object signal 20;
603 step of subsequently receiving, in a first processing unit 10 of the hearing device 2, an input signal 8 comprising a first signal part 30, corresponding at least partly to the first object signal 20, and a second signal part 32;
604 step of applying the determined first set of parameter values 26 of the second sound signal model 28 to the first sound signal model 12;
605 step of processing the input signal 8 according to the first sound signal model 12

The invention claimed is:

1. A method for signal modelling in a hearing device configured to be worn by a user, the hearing device comprising a first input transducer, a first processing unit coupled to the first input transducer and configured to perform signal processing according to a first sound signal model, and an acoustic output transducer for conversion of an output signal from the first processing unit into an audio output signal, the method comprising:

recording a first object signal by a recording unit;

determining, by a second processing unit, a first set of parameter values of a second sound signal model for the first object signal;

receiving, in the first processing unit of the hearing device, an input signal comprising a first signal part and a second signal part, the first signal part corresponding at least partly to the first object signal;

applying the determined first set of parameter values of the second sound signal model to the first sound signal model; and processing the input signal according to the first sound signal model;

wherein the input signal is modelled in the hearing device using a generative probabilistic modelling approach.

2. The method according to claim 1, further comprising:

recording a second object signal by the recording unit;

determining, by the second processing unit, a second set of parameter values of the second sound signal model for the second object signal;

receiving, in the first processing unit of the hearing device, an additional input signal comprising a first signal part and a second signal part, the first signal part of the additional input signal corresponding at least partly to the second object signal;

applying the determined second set of parameter values of the second sound signal model to the first sound signal model; and processing the additional input signal according to the first sound signal model.

3. The method according to claim 2, further comprising generating a library of sets of parameter values for the second sound signal model for respective object signals, the object signals comprising at least the first object signal and the second object signal, wherein the library of sets of parameter values comprises at least the first set of parameter values and the second set of parameter values.

4. The method according to claim 1, further comprising determining whether the input signal corresponds at least partly to the first object signal, wherein the act of applying the determined first set of parameter values to the first sound signal model is performed if the input signal corresponds at least partly to the first object signal.

5. The method according to claim 1, wherein the first set of parameter values of the second sound signal model is stored in a storage, and wherein the first set of parameter values of the second sound signal model is configured to be retrieved from the storage by the second processing unit.

6. The method according to claim 1, wherein the second processing unit is in an electronic device, and wherein the first set of parameter values of the second sound signal model is sent from the electronic device to the hearing device to be applied to the first sound signal model.

7. The method according to claim 1, wherein the recording unit comprises a second input transducer in an electronic device.

8. The method according to claim 1, further comprising modifying the first set of parameter values of the second sound signal model based on an interface output from a user interface.

9. A method for signal modelling in a hearing device configured to be worn by a user, the hearing device comprising a first input transducer, a first processing unit coupled to the first input transducer and configured to perform signal processing according to a first sound signal model, and an acoustic output transducer for conversion of an output signal from the first processing unit into an audio output signal, the method comprising:

recording a first object signal by a recording unit;

determining, by a second processing unit, a first set of parameter values of a second sound signal model for the first object signal;

receiving, in the first processing unit of the hearing device, an input signal comprising a first signal part and a second signal part, the first signal part corresponding at least partly to the first object signal;

applying the determined first set of parameter values of the second sound signal model to the first sound signal model; and processing the input signal according to the first sound signal model;

wherein the act of processing the input signal according to the first sound signal model comprises estimating a set of average spectral power coefficients in each frequency band of a filter bank of the first sound signal model.

10. The method according to claim 9, wherein the act of processing the input signal according to the first sound signal model comprises applying the estimated average spectral power coefficients in a spectral subtraction calculation, wherein a fixed object spectrum is subtracted from a time-varying frequency spectrum of the input signal.

11. The method according to claim 10, wherein the spectral subtraction calculation is performed to estimate a time-varying impact factor based on feature(s) in the input signal.

12. The method according to claim 1, wherein the first object signal is a noise signal to be suppressed in the input signal.

13. The method according to claim 1, wherein the first object signal is a desired signal to be enhanced in the input signal.

14. The method according to claim 1, wherein the act of recording is initiated by the user of the hearing device.

15. A hearing device configured to be worn by a user, the hearing device comprising:

a first input transducer for providing an input signal;

a first processing unit configured for processing the input signal according to a first sound signal model; and an acoustic output transducer coupled to an output of the first processing unit for conversion of an output signal from the first processing unit into an audio output signal;

wherein the hearing device is configured to obtain an input signal comprising a first signal part and a second signal part, the first signal part corresponding at least partly to a first object signal recorded by a recording unit; and wherein the hearing device is also configured to apply a first set of parameter values of a second sound signal model to the first sound signal model;

wherein the hearing device is configured to model the input signal using a generative probabilistic modelling approach, and/or wherein the first processing unit is configured to process the input signal according to the first sound signal model by estimating a set of average spectral power coefficients in each frequency band of a filter bank of the first sound signal model.

16. The hearing device of claim 15, wherein the first set of parameter values of the second sound signal model is associated with the first object signal.

17. A system comprising the hearing device of claim 15, and an electronic device that comprises the recording unit.

18. A system comprising the hearing device of claim 15, and a second processing unit configured to determine the first set of parameter values of the second sound signal model for the first object signal.

19. A system comprising a hearing device configured to be worn by a user and an electronic device;

wherein the hearing device comprises a first input transducer, a first processing unit coupled to the first input transducer and configured to perform signal processing according to a first sound signal model, and an acoustic output transducer coupled to an output of the first processing unit for conversion of an output signal from the first processing unit into an audio output signal;

wherein the electronic device comprises a recording unit, and a second processing unit, wherein the electronic device is configured to record a first object signal by the recording unit, and wherein the second processing unit of the electronic device is configured to determine a first set of parameter values of a second sound signal model for the first object signal;

wherein the hearing device is configured to obtain an input signal comprising a first signal part and a second signal part, the first signal part corresponding at least partly to the first object signal; and wherein the hearing device is also configured to apply the first set of parameter values of the second sound signal model to the first sound signal model, and process the input signal according to the first sound signal model;

wherein the hearing device is configured to model the input signal using a generative probabilistic modelling approach, and/or wherein the first processing unit is configured to process the input signal according to the first sound signal model by estimating a set of average spectral power coefficients in each frequency band of a filter bank of the first sound signal model.

20. The method according to claim 9, further comprising:

recording a second object signal by the recording unit;

determining, by the second processing unit, a second set of parameter values of the second sound signal model for the second object signal;

receiving, in the first processing unit of the hearing device, an additional input signal comprising a first signal part and a second signal part, the first signal part of the additional input signal corresponding at least partly to the second object signal;

applying the determined second set of parameter values of the second sound signal model to the first sound signal model; and processing the additional input signal according to the first sound signal model.

21. The method according to claim 20, further comprising generating a library of sets of parameter values for the second sound signal model for respective object signals, the object signals comprising at least the first object signal and the second object signal, wherein the library of sets of parameter values comprises at least the first set of parameter values and the second set of parameter values.

22. The method according to claim 9, further comprising determining whether the input signal corresponds at least partly to the first object signal, wherein the act of applying the determined first set of parameter values to the first sound signal model is performed if the input signal corresponds at least partly to the first object signal.

23. The method according to claim 9, wherein the first set of parameter values of the second sound signal model is stored in a storage, and wherein the first set of parameter values of the second sound signal model is configured to be retrieved from the storage by the second processing unit.

24. The method according to claim 9, wherein the second processing unit is in an electronic device, and wherein the first set of parameter values of the second sound signal model is sent from the electronic device to the hearing device to be applied to the first sound signal model.

25. The method according to claim 9, wherein the recording unit comprises a second input transducer in an electronic device.

26. The method according to claim 9, further comprising modifying the first set of parameter values of the second sound signal model based on an interface output from a user interface.

27. The method according to claim 9, wherein the first object signal is a noise signal to be suppressed in the input signal.

28. The method according to claim 9, wherein the first object signal is a desired signal to be enhanced in the input signal.

29. The method according to claim 9, wherein the act of recording is initiated by the user of the hearing device.

* * * * *